United States Patent [19]

Carr

[11] Patent Number: 4,840,285

[45] Date of Patent: Jun. 20, 1989

[54] CABINET CONSTRUCTION FOR A DRYER

[75] Inventor: Keith E. Carr, Lincoln Township, Berrien County, Mich.

[73] Assignee: Whirlpool Corporation, Benton Harbor, Mich.

[21] Appl. No.: 914,280

[22] Filed: Oct. 2, 1986

[51] Int. Cl.[4] ..... B65D 6/00

[52] U.S. Cl. ..... 220/47; 68/3 R

[58] Field of Search ..... 220/47; 68/3 R

[56] References Cited

U.S. PATENT DOCUMENTS

| | | | |
|---|---|---|---|
| 2,798,306 | 7/1957 | Reiter . | |
| 2,830,384 | 4/1958 | Zehrbach . | |
| 2,882,610 | 4/1959 | Hughes . | |
| 3,000,108 | 9/1961 | Jones et al. . | |
| 3,309,783 | 3/1967 | Worst . | |
| 3,325,908 | 6/1967 | Gartley . | |
| 3,399,464 | 9/1968 | Erickson et al. . | |
| 3,584,394 | 6/1971 | Grabek . | |
| 3,809,278 | 5/1974 | Csumrik | 220/4 F |
| 3,892,048 | 7/1975 | Jacobsen, Jr. . | |
| 3,917,757 | 11/1975 | Hoah | 220/4 F |
| 4,317,527 | 3/1982 | Belleuille | 220/4 F |
| 4,324,035 | 4/1982 | Sherer . | |
| 4,512,477 | 4/1985 | Densen | 220/4 F |
| 4,560,079 | 12/1985 | Eddleston et al. | 220/4 F |
| 4,570,814 | 2/1986 | Seeley | 220/4 F |
| 4,652,969 | 3/1987 | Stegenga | 220/4 F |

*Primary Examiner*—Joseph Man-Fu Moy

*Attorney, Agent, or Firm*—Hill, Van Santen, Steadman & Simpson

[57] ABSTRACT

A cabinet construction for a clothes dryer is provided wherein the top panel and the front panel are removable from the cabinet assembly from the front of the appliance for purposes of servicing the mechanisms interior of the cabinet all from the front of the dryer. A pair of brackets are attached at the top front corner of the side panels to which both the front panel and top panel are secured. The front panel screws into a projecting lip on said brackets, and the top panel slides rearwardly on the top edges of the side panels until a return flange on the top panel engages with a tab on the brackets to hold the top panel vertically. The top panel is then removably secured in place with at least one screw along the rear edge thereof which is covered by a pivotable control console.

15 Claims, 2 Drawing Sheets

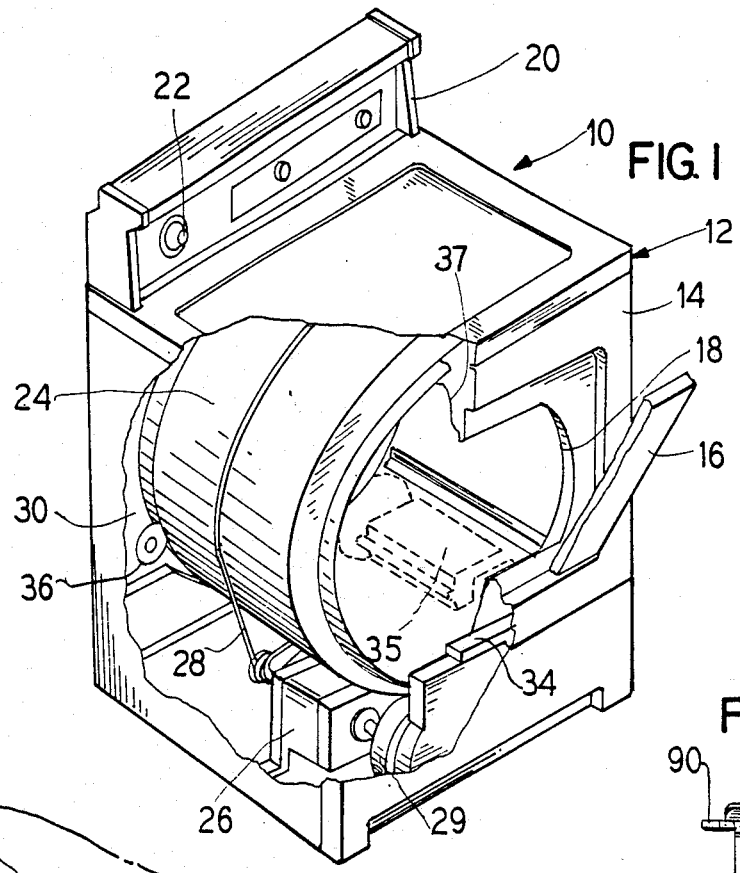
FIG. 1
FIG. 4
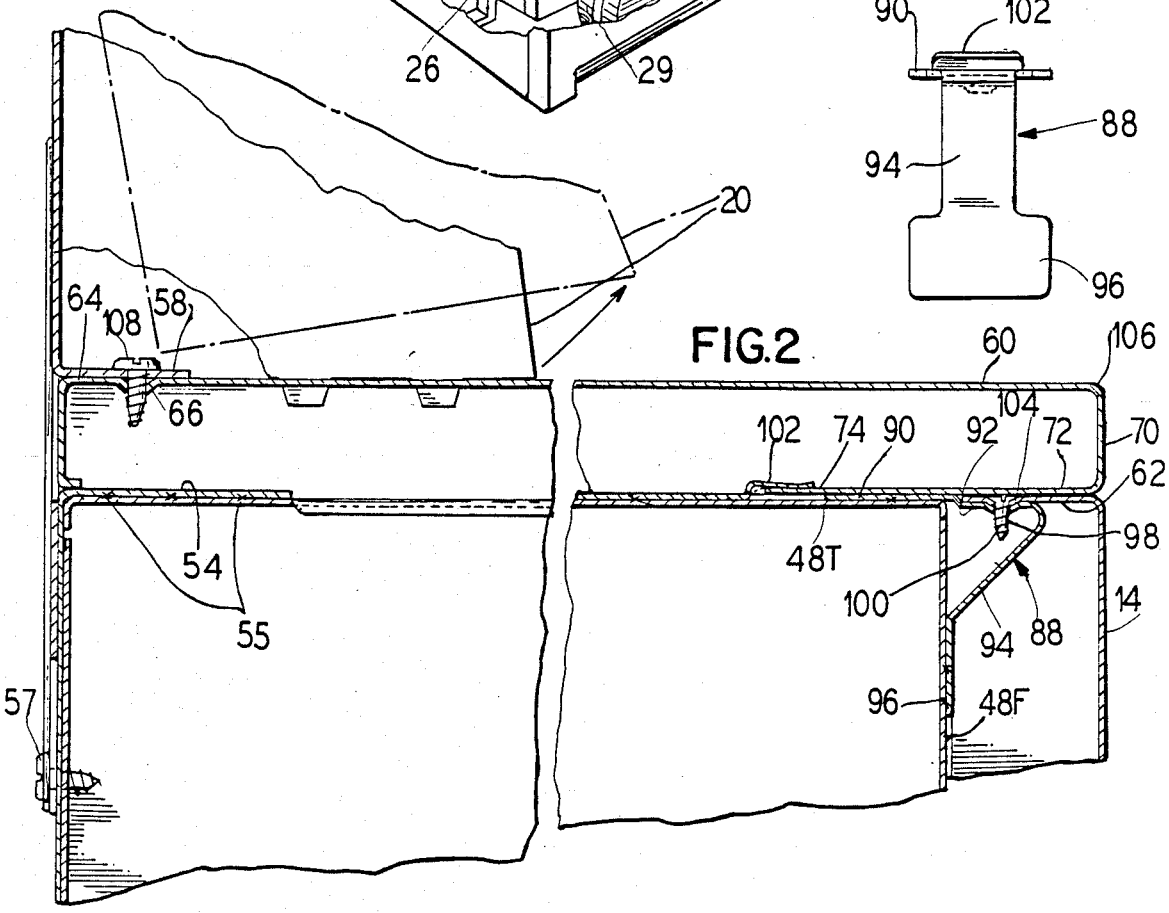
FIG. 2

CABINET CONSTRUCTION FOR A DRYER

BACKGROUND OF THE INVENTION

1. Field of the Invention

The present invention relates to clothes dryers and more particularly to a cabinet construction for a clothes dryer.

2. Description of the Prior Art

In clothes dryers having a horizontal rotating drum there is generally provided an outer cabinet which encloses a drum, an electric motor used to rotate the drum as well as drive an air blower, and a heater which conditions the air used in the drying operation. The cabinet is generally formed out of sheet metal, separately formed into various panels or groups of panels such as the top panel, front panel, rear panel, bottom panels and side panels. Generally, the rear panel is made removable for access to the mechanisms such as the motor and heater described above. Such a removable rear panel is shown in U.S. Pat. No. 2,830,384 at 27. Since the rear panel is generally hidden from view, exposed screws are utilized to hold the panel to the dryer frame as illustrated in FIG. 6. A similar removable back panel 206 is illustrated in U.S. Pat. No. 2,798,306 in FIG. 3. By making only the rear panel removable requires that the back of the dryer be accessible if service to an of the interior mechanisms is required. This often requires the dryer, which is heavy and bulky, to be pulled out of an installed location and sometimes requires the serviceman to work in a somewhat cramped space. Thus, it would be advantageous to provide a clothes dryer having a removable front panel.

U.S. Pat. No. 4,324,035, assigned to the assignee of the present application, discloses a method of attaching a removable cabinet for front-serviceable appliances in which the appliance has a base frame supporting internal components, the base frame having a front member and side members and a rear panel attached thereto. A removable cabinet has a front bottom flange overlapping and extending beneath the front base frame member. Receptacles for receiving upwardly extending tabs from the side members are provided to position the cabinet with respect to the base. The cabinet is held in position on the base by a pair of spring clips engaging the rear panel and each having a portion abutting a top of the cabinet and curved portions extending into the cabinet through aligned slots in the top thereof to maintain a spring tension. The cabinet is thus retained without the use of screws and its removal does not impair the functional operation of the internal components.

SUMMARY OF THE INVENTION

The present invention provides for a construction for a dryer cabinet in which the top and front panels can be removed from the front of the dryer without requiring the back of the dryer to be accessed. A pair of brackets are utilized to secure both the top panel and the front panel to the side panels of the cabinet. The front panel is retained on the brackets by a pair of screws which are normally hidden from view by the overlapping top panel. The top panel is slidingly held in place by a tab on the bracket as well as by screws engaging the rear of the top panel below a pivotable console.

Thus, removal of the front and top panels of the dryer is easily and quickly accomplished by the removal of only four or five screws thus providing access to the interior of the cabinet for servicing.

BRIEF DESCRIPTION OF THE DRAWINGS

FIG. 1 is a perspective view of a dryer embodying the principles of the present invention.

FIG. 2 is a partial side sectional view of the top portion of the dryer cabinet.

FIG. 4 is a front view of the cabinet corner bracket.

DESCRIPTION OF THE PREFERRED EMBODIMENTS

Figure 3:
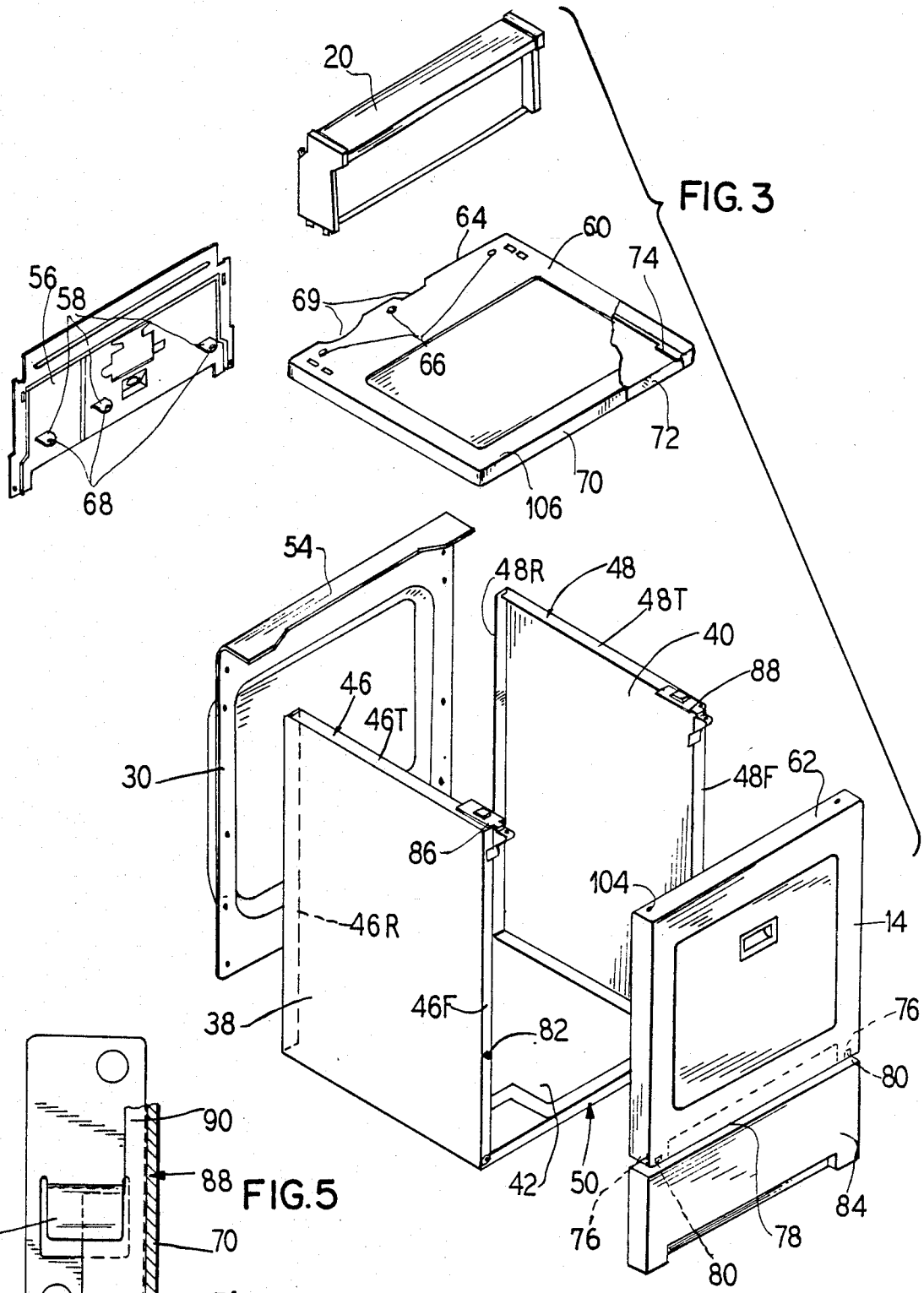
FIG. 3 is an exploded view of the dryer cabinet.

In FIG. 1 there is illustrated a horizontal access clothes dryer 10 embodying the principles of the present invention. The dryer is comprised of a cabinet 12 having a front panel 14 with an openable door 16 revealing an access opening 18. A console 20 having presettable controls 22 thereon allows an operator to select a program of automatic drying and tumbling in a laundry drying process. The door 16 in the front panel 14 of the cabinet 12 permits access through the access opening 18 into the interior of a drum 24 having open ends which is rotatably mounted within the cabinet 12. Below the drum but within the cabinet 12 on one side there is provided an electric motor 26 which rotatably drives the drum by means of a belt 28 and also drives a blower 29. A stationary back panel 30 is provided which has inlet openings (not shown) within the drum for the passage of air circulated by the blower 29 which is used in the drying process. The blower 29 draws air from the drum 24 through a lint filter 34 positioned below the door 16. A heater 35 conditions the air before it enter the drum through the inlet openings. The stationary back wall also has mounted thereon two rollers 36 which support the rear portion of the drum 24. A front portion of the drum is supported by a pair of additional rollers (not shown). A stationary drum front bulkhead 37 is provided between the dryer front panel 14 and the rotating drum 24.

The parts that make up the dryer cabinet 12 are shown in an exploded view in FIG. 3 where it is seen that the dryer cabinet has a pair of opposed, fixed side panels 38, 40 and a fixed bottom panel 42. The side panels 38, 40 and bottom panel 42 may be formed of a single sheet of sheet metal appropriately bent into the configuration shown. Each of the side panels and bottom panels has an inwardly turned flanged edge 46, 48, 50 respectively extending around the periphery of each of those panels. The back panel 30 is secured by appropriate fasteners or by welding to the rear edge flange 46R, 48R of the side and bottom panels.

The back panel 30 has an inwardly turned top flange 54 which overlies and is spot welded at 55 (FIG. 2) to the top edge flanges 46T, 48T of the side panels. An upper rear panel 56 is secured by screws 57 (FIG. 2) to project upwardly above the top edge flange 54 of the rear panel 30. The upper rear panel 56 has a plurality of forwardly extending tabs 58 which are spaced above the top flange 54 of the rear panel.

A top panel 60 is provided which overlies the top edge flanges 46T, 48T of the side panels and the top flange 54 of the rear panel and a top flange 62 of the front panel 14, but which underlies the tabs 58 of the upper rear panel 56. The top panel 60 has along a rear edge 64, fastener openings 66 which align with openings 68 in the tabs 58 of the upper rear panel 56 and recesses 69 for control wires to pass from the console 20 to the mechanisms interior of the dryer cabinet without passing through the top panel. The top panel 60 has a downwardly turned flange 70 extending around the side and front periphery of the top panel 60, which side flange 70 continues into a return flange 72 which proceeds parallel with the top exposed surface of the top panel 60. The return flange 72 has an enlarged portion 74 at each forward side corner (FIGS. 3 & 5; only one shown) which extends rearwardly a short distance, whose purpose is explained in greater detail below.

The front panel 14 has a pair of downward extensions 76 positioned at either lateral side of the panel along a bottom edge 78 thereof. The extensions each have a downwardly opening slot 80 which is positioned to engage a post member, such as screw 82, projecting from the front flanges 46F, 48F of the side panels 38, 40. The post and slot engagement provides a positive vertical positioning and alignment of the front panel relative to the side panels. A removable toe panel 84 is positioned below the front panel 14 and removably attaches to the side panels 38 and 40.

Figure 5:
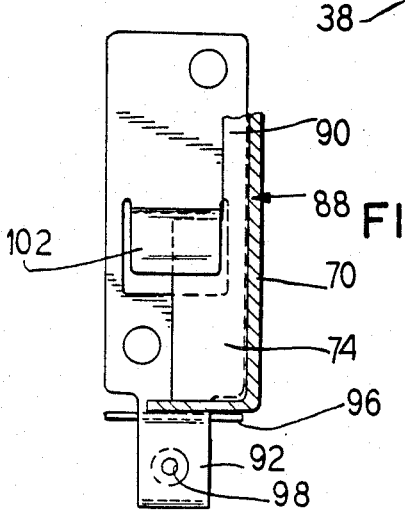
FIG. 5 is a top view of the cabinet corner bracket.

A pair of brackets 86, 88 are attached to the edge flanges 46, 48 of the side panels at the corner of the top edge and front edge to provide a means for attaching the front panel 14 and top panel 60 to the side and bottom panels. As seen in FIGS. 2, 4 and 5, the brackets 86, 88 have a top plate portion 90 which overlies and is secured to the top edge flange 48T of the side wall such as by welding. A lip portion 92 extends forwardly beyond the front edge flange 48F and is connected to a downwardly extending support arm 94 which angles rearwardly toward the front flange 48F and terminates in a mounting end 96 which can be secured to the front edge flange of the side panels again by welding. The forwardly extending lip 92 has a aperture 98 therein for receiving a threaded fastener or screw 100. The top plate portion 90 has a forwardly extending tab 102 spaced slightly above the plate 90 to capture the enlarged portion 74 of the return flange 72 of the top panel 60.

The assembly of parts is shown in detail in FIG. 2 which illustrates the bracket 88 secured to the top 48T and front 48F flanges of the side panel 40. The top flange 62 of the front panel 14 overlies the projecting lip 92 of the bracket 88 and has an aperture 104 therein to receive the screw 100 to secure the front panel 14 to the bracket 88 and thus to the side panel 40. An identical arrangement is provided at the side panel 38 and bracket 86.

The top panel 60 is placed on the top edge flanges 46T, 48T of the side panels and the top flange 62 of the front panel such that a front edge 106 of the top panel is extended forwardly of the front panel 14. The top panel 60 is then slid rearwardly until the rear edge 64 slides under the forwardly projecting flanges 58 of the top rear panel 56 and the enlarged portion 74 of the return flange 72 slides beneath the tab 102 of the bracket 88. In this manner, both the rear edge 64 and front edge 106 of the top panel 60 are secured against vertical movement. The flanges 72 acting against tabs 102 prevent horizontal movement of the top panel front portion. Two or three threaded fasteners such as screws 108 can then be secured through the flanges 58 and apertures 66 along the rear edge 64 of the top panel to prevent the top panel from sliding forwardly. In this position the front edge 106 of the top panel will overlie the top flange 62 of the front panel such that the screws 100 will not be exposed and can be removed only by prior removal of the top panel.

The console 20 is pivotally attached to the top rear panel 56 and can be pivoted downwardly to overlie the rear edge 64 of the top panel 60 and thus cover the screws 108.

The top and front panels are quickly and easily removed by first pivoting the console upwardly as illustrated in phantom in FIG. 2 to provide access to the fasteners 108 securing the tabs 58 and top panel 60 together. Once the fasteners are removed, the top panel 60 is slid forwardly to disengage the return flange 72 from the tab 102 at which time the top panel can be completely removed from the remainder of the dryer cabinet. With the top panel removed, the two retaining screws 100 holding the front panel 14 to the side panels 38, 40 are exposed. By removing the two screws 100 and loosening the screws 82, the front panel can then be removed upwardly away from the remainder of the dryer assembly disengaging the slots 80 from the screws 82. Thus, the dryer may be serviced, that is the part replaced or the other internal mechanisms removed or serviced without accessing the rear of the dryer. Also, by removing the toe panel 84 and the top panel 60 in accordance with the above procedure, the console can then be pivoted back into place to operate the dryer with the top and toe panels removed if desired to visually check the operation of the dryer internal parts. Thus, such a construction greatly enhances the ease of serviceability of the dryer while maintaining an easy to assemble cabinet structure.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A cabinet construction for a dryer comprising:
   - a pair of spaced apart and essentially parallel side panels having back edges, front edges and top edges;
   - a bottom panel having back edges and side edges permanently attached at either lateral side edge to said side panels;
   - a rear panel attached to said back edges of said side and bottom panels;
   - a front panel removably attachable to said front edges of said side panels;
   - a top panel removably attachable to said top edges of said side panels; and
   - a bracket attached to each side panel adjacent to a junction of said top edge and said side edge, said top panel and said front panel being removably attached to said brackets.

2. A cabinet construction according to claim 1, wherein said side panels and said bottom panel are formed from a single sheet of metal bent at appropriate locations.

3. A cabinet construction according to claim 1, wherein said rear panel includes a portion which extends upwardly above and is secured to a top edge of said side panels.

4. A cabinet construction according to claim 3, wherein said portion of said rear panel which extends upwardly is a separate panel portion securable to said rear panel.

5. A cabinet construction according to claim 1, wherein said side panels have an inwardly turned front flange along said front edge and an inwardly turned top flange along a top edge, said brackets being attached to said front and top flanges, said front flanges additionally each having a forwardly projecting post extending therefrom spaced below said top edge of said side panels, and said front panel having a pair of spaced slots engagable with said posts to align said front panel with said side panels.

6. A cabinet construction according to claim 1, wherein said brackets have a lip portion which extends forwardly of said front edge of said side panels to be engaged by said front panel and a tab projecting above said top edge of said side panels to engage said top panel.

7. A cabinet construction according to claim 6, wherein said top panel has a return flange portion slidingly engagable with said bracket tab into an assembled position whereby said top panel will be held vertically to said side panels upon said sliding engagement.

8. A cabinet construction according to claim 7, wherein said rear panel has at least one forwardly projecting tab spaced above said top edge of said side panels to overlie said top panel after it is slid into an assembled position, and fasteners extending between said tabs and said top panel to secure said top panel horizontally.

9. A cabinet construction according to claim 1, wherein said rear panel is permanently attached to said side and bottom panels.

10. A cabinet construction for a dryer comprising:

a pair of spaced apart and essentially parallel side panels formed integrally with an intermediate bottom panel by bending a single piece of sheet metal to form an open rear, front and top;

a lower rear panel permanently attached to said open rear;

an upper rear panel secured to said lower rear panel to extend upwardly above a top edge of s id side panels;

said upper rear panel having at least one tab projecting forwardly which is spaced above said top edge of said side panels;

a bracket permanently secured to each of said side panels at a top front corner thereof;

said brackets each having a forwardly projecting lip and a upstanding and forwardly projecting tab;

a post projecting forwardly from a front edge of each side panel spaced below said top edge;

a front panel having a pair of slots therein positioned to engage with said posts on said side panels to align said front panel with said side panels and a top flange bent to overlie said projecting bracket lips;

fastening means to removably attach said front panel top flange to said bracket lip;

a top panel having a return flange to slidingly engage with said bracket tab to hold said top panel vertically to said side panels; and fastening means to removably attach said top panel to said upper rear panel flange to hold said top panel horizontally to said cabinet.

11. A cabinet construction for a dryer according to claim 10, wherein said rear panel is attached to said side panels by welding.

12. A cabinet construction for a dryer according to claim 10, wherein a front edge of said top panel overlies a top edge of said front panel to cover said fastening means from view.

13. A cabinet construction for a dryer according to claim 10, including a console pivotally mounted to said upper rear panel to pivot toward and away from said top panel to cover said fastening means from view.

14. A cabinet construction for a dryer comprising:

a one piece cabinet part forming two spaced apart and essentially parallel side panels having front edges and top edges, and a bottom panel;

an enclosure portion of two panel units forming a front panel and a top panel; and attachment means for removably securing said enclosure portion to said cabinet part, said attachment means comprising a bracket attached to each side panel adjacent to a junction of said top edge and said side edge, said enclosure portion being removeably attached to said brackets.

15. A cabinet construction according to claim 14, wherein said construction includes a rear panel attached to said cabinet part.

* * * * *